United States Patent [19]

Tsuchida et al.

[11] 4,378,111

[45] Mar. 29, 1983

[54] PHYSICAL EXERCISE APPLIANCE

[75] Inventors: Yasuyuki Tsuchida, Hyogo; Yuuichi Okada, Kasai, both of Japan

[73] Assignee: Sanyo Electric Co., Ltd., Moriguchi, Japan

[21] Appl. No.: 212,202

[22] Filed: Dec. 2, 1980

[30] Foreign Application Priority Data

Dec. 7, 1979 [JP] Japan ..... 54-159439
Dec. 10, 1979 [JP] Japan ..... 54-160618

[51] Int. Cl.[3] ..... A63B 23/04

[52] U.S. Cl. ..... 272/73; 272/69; 272/DIG. 5; 73/379

[58] Field of Search ..... 272/69–73, 272/100, 129, DIG. 5, DIG. 6; 128/689, 706, 707, 709, 363, 696; 73/379; 364/410, 413; 340/323 R

[56] References Cited

U.S. PATENT DOCUMENTS 4,244,021 1/1981 Chiles ..... 272/73
4,278,095 7/1981 Lapeyre ..... 272/69

*Primary Examiner*—Vance Y. Hum
*Attorney, Agent, or Firm*—Darby & Darby

[57] ABSTRACT

This invention discloses a physical exercise appliance comprising an indicator device for selectively indicating exercise data or heart-pulse frequency data of the user or exerciser during the application of his physical energy. A circuit is provided for alternately indicating the exercise data and the heart-pulse frequency data on the indicator device at predetermined intervals when the indication of exercise data is designated. The circuit only indicates the heart-pulse frequency data on the indicator device when the indication of heart-pulse frequency data is designated.

The heart-pulse frequency data may be read out at predetermined intervals, while exercise data such as an exercise period of time or an exercise speed are indicated on the indicator device. Therefore the user or exerciser can always know his physical conditions during the application of his physical energy and can pay attention such that he does not apply excessively his physical energy, thereby preventing him from becoming too tired.

Furthermore, such repeated indication of exercise data and heart-pulse frequency data on the indicator device may also provide an entertaining atmosphere, so that the user may take exercise pleasantly.

3 Claims, 10 Drawing Figures

PHYSICAL EXERCISE APPLIANCE

TECHNICAL FIELD OF THE INVENTION

The present invention relates to a physical exercise appliance, such as a physical training bicycle and an indoor jogger device, which is constructed so as to indicate the exercise data (exercise period of time, exercise speed, etc.) and the heart-pulse frequency data of the user or exerciser during the application of his physical energy, and more particularly to a physical exercise appliance constructed so as to indicate the heart-pulse frequency data of the user or exerciser alternately with his exercise data.

BACKGROUND OF THE INVENTION

It is generally known that the change in the physical state of an exerciser during the application of his physical energy exhibits the change in his heart-pulse frequency. It is therefore possible to know the fatigue of the exerciser by knowing the change in his heart-pulse frequency.

A conventional physical training appliance such as a physical training bicycle or an indoor jogger device, is constructed so as to selectively indicate the exercise data or the heart-pulse frequency data of the user or exerciser during the application of his physical energy, on one indicator device with a selector switch used. Accordingly, the heart-pulse frequency data are not indicated at all on the indicator device during the time the exercise data are being indicated. Therefore, the user or exerciser cannot know his physical condition during the application of his physical energy, which may cause the user to excessively apply his physical energy. Such overexercise may ruin his health.

SUMMARY OF THE INVENTION

A physical exercise appliance in accordance with the present invention comprises an indicator device for selectively indicating the exercise data or the heart-pulse frequency data of the user or exerciser during the application of his physical energy, means for alternately indicating the exercise data and the heart-pulse frequency data on the indicator device at predetermined intervals when the indication of exercise data is designated, and means for indicating only the heart-pulse frequency data on the indicator device when the indication of heart-pulse frequency data is designated.

BRIEF DESCRIPTION OF THE DRAWINGS

The present invention will be further described, by way of example, with reference to the accompanying drawings, in which.

DETAILED DESCRIPTION OF PREFERRED EMBODIMENTS

Figure 1:
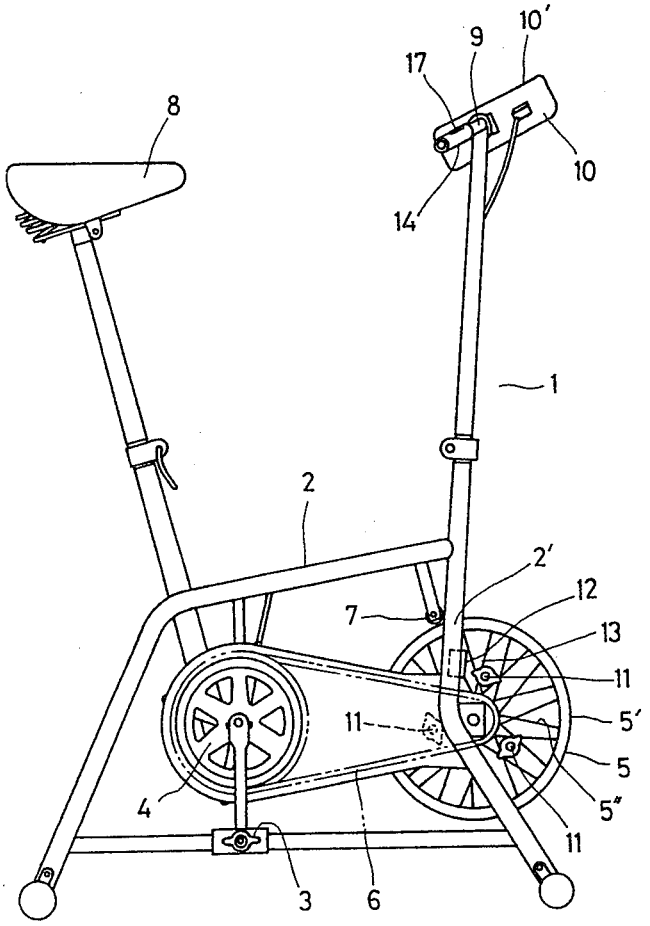
FIG. 1 is a side view of a first embodiment of a physical exercise appliance in accordance with the present invention.
Figure 2A:
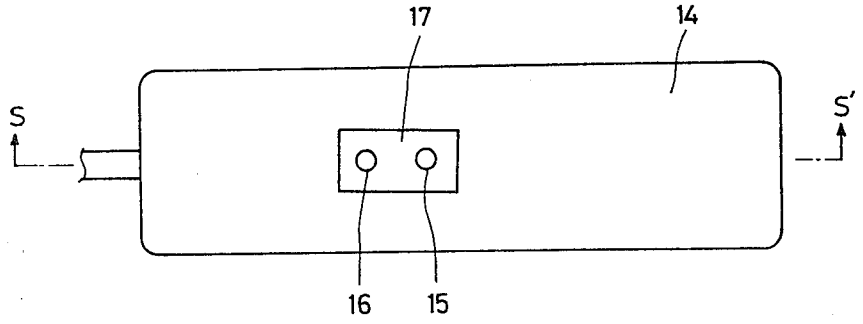
FIG. 2(A) is a plan view of a heart-pulse sensor used in the appliance shown in FIG. 1.
Figure 2B:
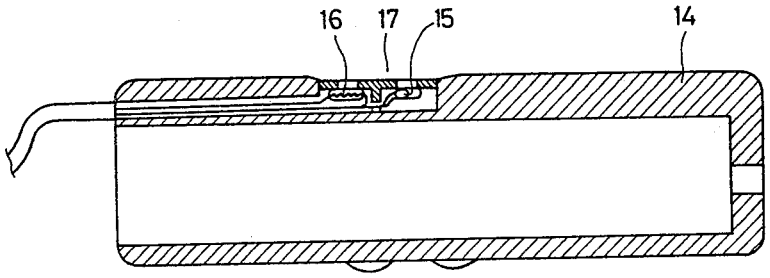
FIG. 2(B) is a section view of the heart-pulse sensor taken along the line S—S' in FIG. 2(A)

The description hereinafter will discuss a first embodiment of physical exercise appliance in accordance with the present invention, with reference to FIGS. 1 to 5.

FIGS. 1 to 5 illustrate an embodiment where the present invention is applied to a physical training bicycle.

A physical training bicycle 1 to be installed on the floor has a vehicle body frame 2, which has pedals 3 and a gear crank 4 for the pedals 3. A wheel 5 is rotatably disposed at the frame 2. A chain 6 connects the wheel 5 to the gear crank 4. A mechanical-type brake means 7 projects from the frame 2 so as to be press-contacted with the peripheral portion 5' of the wheel 5. With such an arrangement, when the pedals 3 are foot-driven, the wheel 5 is rotated by the chain 6. By changing the degree of the press-contact of the mechanical-type brake means 7 with the wheel 5, the load to be applied to the wheel 5 may be changed.

A saddle or seat 8 and a handle bar 9 are disposed on the frame 2. An indicator case 10 is mounted to the handle bar at the center portion thereof.

Three magnets 11 are concentrically disposed on the spoke means 5" of the wheel 5 at regular intervals. A hole element 12 for detecting the change in the magnetic flux is disposed on a stay 2' of the frame 2 opposite the three magnets 11. The magnets 11 and the hole element 12 constitute a wheel rotation sensor 13 for measuring the number of rotations of the wheel 5.

A heart-pulse sensor 17 comprising a light emitting element 15 and a light receiving element 16 is embedded in the grip cover 14 on the right hand side of the handle bar 9.

When the user or exerciser sits on the saddle 8 and works the pedals 3 with the grip cover 14 clasped, frictional travelling load is applied to the user, and the wheel rotation sensor 13 measures the number of rotations of the wheel 5 simultaneously with the measurement of the heart-pulse frequency by the heart-pulse sensor 17. The outputs from these sensors 13, 17 are supplied to and arithmetically processed in the electrical circuit (to be discussed later) incorporated in the indicator case 10, and are then read out as exercise period of time or exercise speed and heart-pulse frequency data. These data are selectively indicated on an indicator device 18 comprising a plurality of indicator elements disposed on the indicator face 10' of the indicator case 10.

Disposed on the indicator case 10 are a power supply switch 19, push-button type indication switches 20, 21 and 22 which cause an exercise period of time, an exercise speed and a heart-pulse frequency to be respectively indicated on the indicator device 18, and time, speed and pulse indication lamps 23, 24 and 25 for indicating which data among an exercise period of time, an exercise speed and a heart-pulse frequency are indicated on the indicator device 18. There is also disposed on the indicator case 10 a heart-pulse input indication lamp 26 that turns on and off in synchronish with a heart-pulse frequency supplied to the heart pulse sensor 17, thereby indicating the presence of an input from the heart pulse sensor 17.

The indicator case 10 has a heart-pulse sensor mounting hole 27 to which the connecting plug 17' of the heart pulse sensor 17 is removably mounted, and a wheel rotation sensor mounting hole 28 to which the connecting plug 13' of the wheel rotation sensor 13 is removably mounted.

Figure 4:
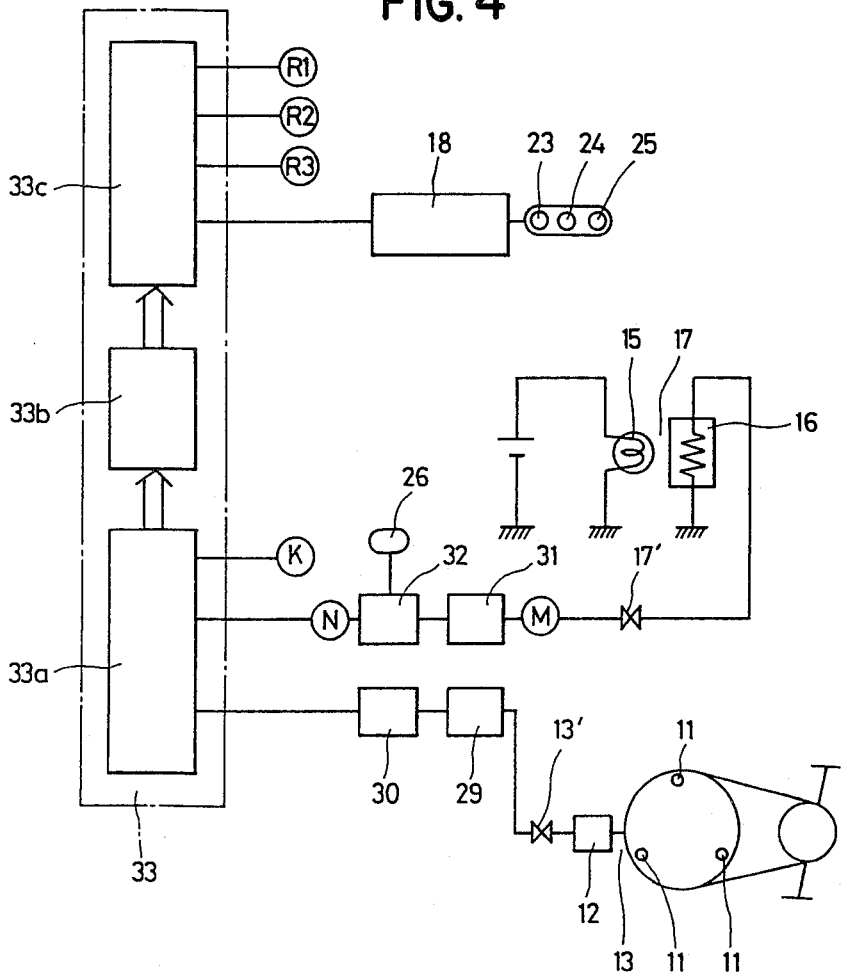
FIG. 4 is a circuit diagram of an arithmetic unit used in the appliance shown in FIG. 1.

The description hereinafter will discuss the arithmetic unit of the electric circuit used in the physical training bicycle 1, with reference to FIG. 4.

A first amplifier circuit 29 amplifies the output signal related to the number of wheel rotations as measured by the wheel rotation sensor 13. A first monostable circuit 30 shapes the wave form of the output from the first amplifier circuit 29. A second amplifier circuit 31 amplifies the output signal related to the heart pulse frequency as detected by the heart-pulse sensor 17. A second monostable circuit 32 shapes the wave from of the output from the second amplifier circuit 31. A microcomputer unit 33 comprises an input unit 33*a*, a central processing unit 33*b* and an output unit 33*c*.

The outputs from the first and second mono stable circuits 30 and 32 are supplied to the input unit 33*a*. An exercise period of time, an exercise speed and a heart-pulse frequency are calculated by the central processing unit 33*b*. Any one of the scan signals at the first, second and third scan output terminals R1, R2 and R3 of the output unit 33*c* is suitably selected by an indication output selector unit to be discussed later. A signal related to the selected output is supplied from a key input terminal K to the input unit 33*a*, so that exercise data such as an exercise period of time or an exercise speed, or heart-pulse frequency data are selectively read out from the output unit 33*c*. Thus selected data are indicated on the indicator device 18, simultaneously with that, either the time indication lamp 23, the speed indication lamp 24 and the heart-pulse frequency indication lamp 25 is lighted, thus indicating which data are indicated on the indicator device 18.

Figure 5:
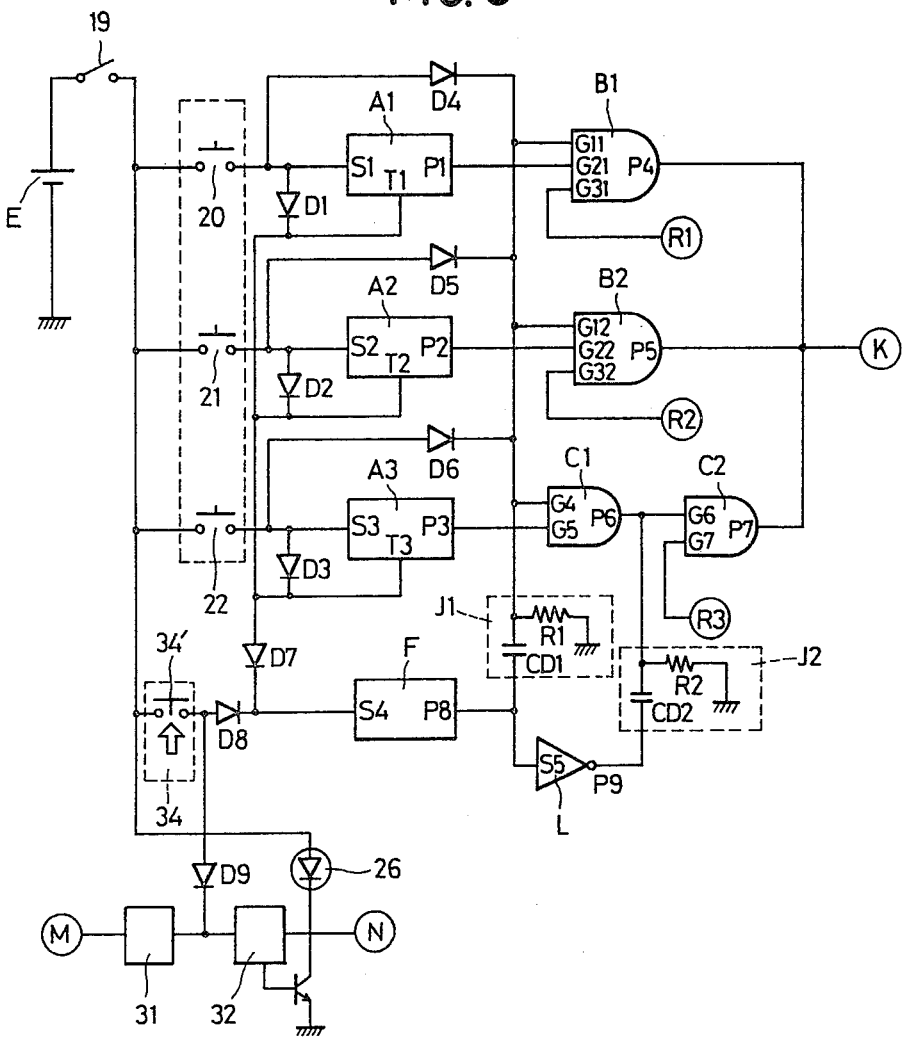
FIG. 5 is a circuit diagram of portions of a heart-pulse frequency input unit and an indication output selector unit used in the appliance shown in FIG. 1.

The description hereinafter will discuss portions of the heart-pulse frequency input unit and the indication output selector unit in the electric circuit incorporated in the indicator case 10 of the physical training bicycle 1, with reference to FIG. 5.

A power supply is generally designated by E. The push-button type indication switches 20, 21 and 22 which cause an exercise period of time, an exercise speed and a heart-pulse frequency to be respectively indicated on the indicator device 18, are of the normally open type.

First, second and third memory circuits A1, A2 and A3 are connected to the indication switches 20, 21 and 22, respectively, and are constituted by set-priority flip-flop circuits.

First, second and third diodes D1, D2 and D3 are connected to the set terminals S1, S2 and S3 and to the reset terminals T1, T2 and T3 of the memory circuits A1, A2 and A3, respectively.

For example, when the time indication switch 20 is pressed so as to be turned ON, the output of the first memory circuit A1 changes to the high level state (Hi-level), and even if the switch 20 is turned OFF, this Hi-level is maintained. When another switch, for example the speed indication switch 21 is pressed, the reset terminal T1 of the first memory circuit A1 has the Hi-level applied to it through the second diode D2 and the output of the first memory circuit A1 changes to the low level state (Lo-level).

First and second 3-input AND gate circuits B1 and B2 have first input terminals G11 and G12, respectively, connected to the time indication switch 20 and the speed indication switch 21 through forth and fifth diodes D4 and D5, respectively. The second input terminals G21 and G22 of the 3-input AND gate circuits B1 and B2 are connected to the output terminals P1 and P2 of the first and second memory circuits A1 and A2, respectively. The third input terminals G31 and G32 of the 3-input AND gate circuits B1 and B2 are connected to the first and second scan output terminals R1 and R2 of the microcomputer unit 33, respectively.

A first 2-input AND gate circuit C1 has one input terminal G4 connected to the heart-pulse frequency indication switch 22 through a sixth diode D6, and the other input terminal G5 connected to the output terminal P3 of the third memory circuit A3.

A second 2-input AND gate circuit C2 has one input terminal G6 connected to the output terminal P6 of the first 2-input AND gate circuit C1, and the other input terminal G7 connected to the third scan output terminal R3 of the microcomputer unit 33.

The output terminals P4 and P5 of the first and second 3-input AND gate circuits B1 and B2, and the output terminal P7 of the second 2-input AND gate circuit C2 are all connected to the key input terminal K of the microcomputer unit 33.

An indication time control circuit F incorporates a timer for switching the Lo-level output to the Hi-level output and vice versa at regular intervals (e.g. every 7 seconds). The input terminal S4 of the circuit F is connected to the reset terminals T1, T2 and T3 of the first, second and third memory circuits A1, A2 and A3 through a seventh diode D7. The output terminal P8 of the circuit F is connected to the first input terminals G11 and G12 of the first and second 3-input AND gate circuits B1 and B2 and to the input terminal G4 of the first AND gate circuit C1, through a first differentiation circuit J1 comprising a resistor R1 and a capacitor CD1.

The inverter circuit L inverts the state of output of the indication time control circuit F. The input terminal S5 of the inverter circuit L is connected to the output terminal P8 of the control circuit F. The output terminal P9 of the inverter circuit L is connected to the input terminal G6 of the second 2-input AND gate circuit C2 through a second differentiation circuit J2 comprising a resistor R2 and a capacitor CD2.

Figure 3A:
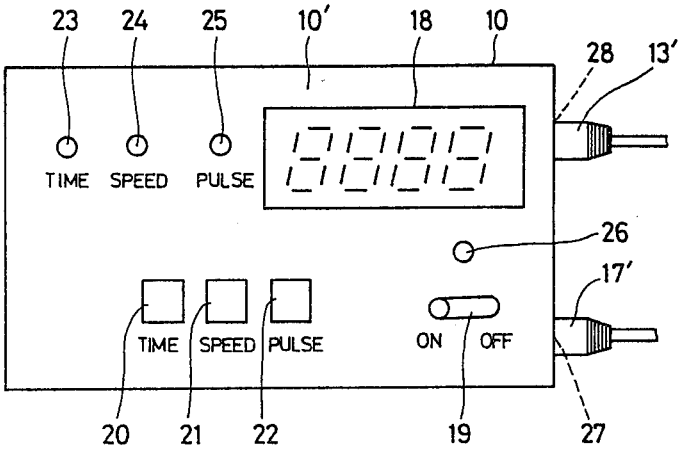
FIG. 3(A) is a plan view of an indicator case used in the appliance shown in FIG. 1, with a wheel rotation sensor and the heart-pulse sensor mounted thereto.
Figure 3B:
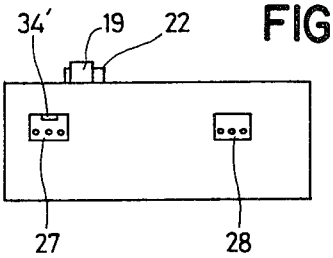
FIG. 3(B) is a side view of the indicator case shown in FIG. 3(A), with the both sensors removed therefrom.
Figure 3C:
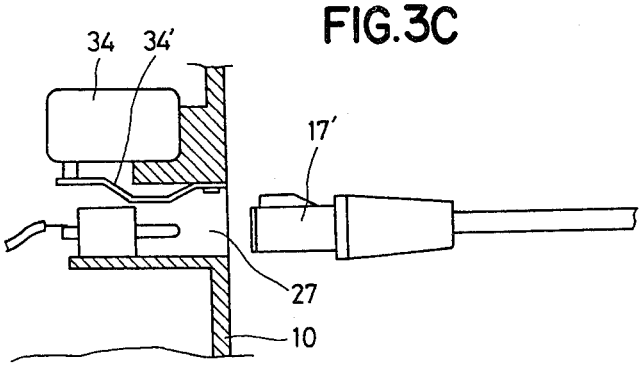
FIG. 3(C) is a section view of portions of the indicator case shown in FIG. 3(A), with the heart-pulse sensor removed therefrom.

A heart-pulse sensor switch 34 of the normally closed type short-circuits a power switch 19 to the input terminal S4 of the indication time control circuit F through an eighth diode D8. As shown in FIG. 3(C), this heart-pulse sensor switch 34 has a working rod 34' which projects into the heart-pulse sensor mounting hole 27 of the indicator case 10. When the heart-pulse sensor 17 is mounted to the indicator case 10 with the connecting plug 17' inserted into the mounting hole 27, the switch 34 is adapted to be opened. That is, the switch 34 is maintained as opened during the measurement of a heart-pulse frequency.

A nineth diode D9 is connected in the forward direction between the input terminal of the second monostable circuit 32 and the connection of the heart-pulse sensor switch 34 with the eighth diode D8. When the heart-pulse sensor switch 34 is closed, the nineth diode D9 maintains the input terminal of the second monostable circuit 32 at a high level. With the connecting plug 17' of the heart pulse sensor 17 removed from the heart-pulse sensor mounting hole 27, such maintenance of the high level causes noise from the second amplifier circuit 31 not to be received, so that erroneous data due to such noise are not supplied to the microcomputer unit 33 and the heart-pulse input indication lamp 26 is not lighted.

The description hereinafter will discuss the operation of the embodiment mentioned hereinbefore.

When the heart-pulse sensor connecting plug 17' is inserted into the heart-pulse sensor mounting hole 27 of the indicator case 10 and the user, who is sitting on the saddle 8 and clasping the grip cover 14, works the pedals 3 or starts taking exercise after the power switch 19 has been closed, the heart-pulse input indication lamp 26 flickers in synchronism with the heart-pulse frequency detected by the heart-pulse sensor 17.

When the exercise data indication switch, for example the time indication switch 20, is then pressed, the first input terminal G11 of the first 3-input AND gate circuit B1 has the Hi-level applied to it through the fourth diode D4 and the output of the first memory circuit A1 changes to the Hi-level. When the scan output of the microcomputer unit 33 is read out to the first scan output terminal R1 at this time, the output of the first 3-input AND gate circuit B1 changes to the Hi-level and is supplied to the key input terminal K. Accordingly, an exercise period of time or exercise data are read out from the microcomputer unit 33 and are indicated on the indicator device 18, and simultaneously with that the time indication lamp 23 is lighted. Even if the time indication switch 20 is thereafter released, the indication is maintained as it is.

On the other hand, by pressing the switch 20, the input terminal S4 of the indication time control circuit F has the Hi-level applied to it through D1 and D7, and the timer incorporated in the indication time control circuit F is reset or cleared. When the time indication switch 20 is thereafter released, the timer operates and the counting is started. After 7 seconds has passed, the output terminal P8 of the indication time control circuit F changes to the Lo-level from the Hi-level. At this time, the first input terminal G11 of the first 3-input AND gate circuit B1 has the Lo-level applied to it through J1 and a pulse at the Hi-level is supplied to one input terminal G6 of the second 2-input AND gate circuit C2 through the inverter circuit L. When the scan output of the microcomputer unit 33 is read out to the third scan output terminal R3 at this time, the output of the second 2-input AND gate circuit C2 changes to the Hi-level and is supplied to the key input terminal K. Therefore, heart-pulse frequency data are given out from the microcomputer unit 33 and are indicated on the indicator device 18 with the heart-pulse frequency indication lamp 25 lighted on.

After 7 seconds has further passed, the output of the indication time control circuit F again changes to the Hi-level. Therefore, the first input terminal G11 of the first 3-input AND gate circuit B1 receives the Hi-level and the input to the second 2-input AND gate circuit C2 receives the Lo-level. As stated earlier, an exercise period of time is therefore indicated, and thereafter the heart-pulse frequency data and exercise data for an exercise period of time are repeatedly indicated alternately every 7 seconds on the indicator device 18, simultaneously with which the heart-pulse frequency indication lamp 25 and the time indication lamp 23 are alternately lighted.

When the exercise speed indication switch 21 is pressed, an exercise speed and heart-pulse frequency data are repeatedly indicated alternately on the indicator device 18 every 7 seconds, simultaneously with which the speed indication lamp 24 and the heart-pulse frequency indication lamp 25 are alternately lighted.

When the heart-pulse frequency indication switch 22 is pressed, both the input terminals G4 and G5 of the first 2-input AND gate circuit C1 receive the Hi-level. Therefore, one input terminal G6 of the second 2-input AND gate circuit C2 receives the Hi-level. When the scan output from the microcomputer unit 33 is supplied to the other input terminal G7 through the third scan output terminal R3, the Hi-level output is supplied from the second 2-input AND gate circuit C2 to the key input terminal K. Accordingly, the heart-pulse frequency data are read out from the microcomputer unit 33 and are indicated on the indicator device 18, simultaneously with which the heart-pulse frequency indication lamp 25 is lighted. After 7 seconds has passed, a heart-pulse frequency is again indicated as mentioned earlier. Thereafter, such indication is repeated. Thus, only heart-pulse frequency data are indicated on the indicator device 18.

The first and second differentiation circuits J1 and J2 convert the output of the indication time control circuit F into a trigger pulse of about 50 m sec. Therefore, these differentiation circuits J1 and J2 supply a thus triggered output from the indication time control circuit F to the first 3-input AND gate circuit B1 or the second 3-input AND gate circuit B2, and to the second 2-input AND gate circuit C2, so that exercise data and heart-pulse frequency data are securely indicated alternately on the indicator device 18.

When the heart-pulse sensor connecting plug 17' is removed from the heart-pulse sensor mounting hole 27, the heart-pulse sensor switch 34 is closed, so that the input terminal S4 of the indication time control circuit F is maintained at the Hi-level. Therefore, the circuit F does not count and the output terminal P8 is maintained at the Hi-level. Accordingly, the second 2-input AND gate circuit C2 is maintained at the Lo-level and a heart-pulse frequency is not indicated on the indicator device 18. Thus, only exercise data for an exercise period of time or exercise speed are indicated on the indicator device 18.

Furthermore, the second monostable circuit 32 is maintained at high level through the nineth diode D9. Therefore, erroneous data are not supplied to the microcomputer unit 33 and the heart-pulse input lamp 26 turns out.

The description hereinafter will discuss a second embodiment in which a physical exercise appliance of the present invention is applied to an indoor jogger device, with reference to FIGS. 6 and 7.

Figure 6:
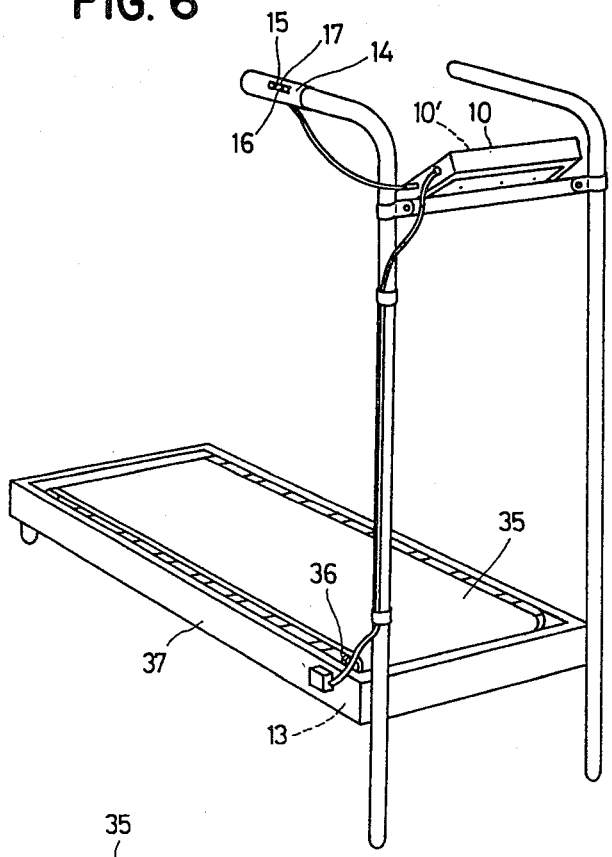
FIG. 6 is a perspective view of a second embodiment of physical exercise appliance in accordance with the present invention.
Figure 7:
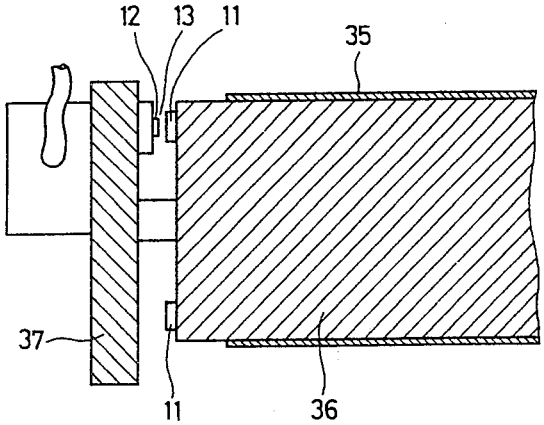
FIG. 7 is a section view of portions of the appliance shown in FIG. 6.

In FIGS. 6 and 7, like parts are designated by like numerals in FIGS. 1 to 5.

A travelling belt is generally designated by 35. A roller shaft of the belt 35 is generally designated by 36. The magnets 11 of the wheel rotation sensor 13 are attached to the lateral side of the roller shaft 36. The hole element 12 is attached to a frame 37.

The operation of this embodiment is the same as that of the first embodiment.

Industrial Utility

According to the physical exercise appliance of the present invention, heart-pulse frequency data can be given at predetermined intervals while exercise data, such as exercise period of time or exercise speed, are indicated on the indicator device. Therefore, the user or exerciser can always know his physical conditions during the application of his physical energy and can pay attention, such that he does not apply excessively his physical energy, thereby preventing him from getting too tired.

Furthermore, repeated indications of exercise data and heart-pulse frequency data on the indicator device may also provide an entertaining atmosphere, so that the user or exerciser may take exercise pleasantly.

Moreover, according to the present invention, there are disposed a plurality of push-button type indication switches to cause the exercise data and the heart-pulse frequency data to be respectively indicated on the indicator device, and an indication time control circuit for controlling an indication period of time for such data. Therefore, when the exercise data indication switch among these indication switches is pressed, the exercise data and the heart-pulse frequency data are alternately read out dependent on the two stable state outputs of the indication time control circuit. On the other hand, when the heart-pulse frequency indication switch is pressed, the inverter circuit connected to the indication time control circuit inverts the two stable state outputs of the indication time control circuit into one of two stable state outputs, so that only heart-pulse frequency data are read out. Thus, the circuit construction is very simple.

Furthermore, the heart-pulse sensor connecting plug may be removably mounted to the heart-pulse sensor mounting hole of the indicator case and there is disposed a switch to be opened and closed according to the attachment and removal of this connecting plug to and from the mounting hole. The attachment of the connecing plug to the mounting hole permits the exercise data or the heart-pulse frequency data to be selectively indicated on the indicator device. The removal of the connecting plug from the mounting hole permits only the exercise data to be indicated on the indicator device. Thus, when the measurement of a heart-pulse frequency is not required, such a simple operation as the removal of the connecting plug from the mounting hole prevents the heart-pulse frequency data from being indicated on the indicator device. Accordingly, the physical exercise appliance of the present invention is easy to use without puzzling the user and may be pleasantly used.

What we claim is:

1. Physical exercise appliance comprising:

a single digital indicator device for selectively displaying exercise data or heart-pulse frequency data of the user during the application of his physical energy;

a plurality of indication switches to cause the exercise data and the heart-pulse frequency data to be respectively indicated on said digital indicator device;

an indication time control circuit for alternately producing two stable state outputs that control the display period of time for the exercise data and the heart-pulse frequency data displayed on said indicator device, respectively;

means for automatically and alternately causing the exercise data and the heart-pulse frequency data to be displayed on said single digital indicator device for a period dependent on said two stable state outputs of said indication time control circuit when an exercise data indication switch, among said plurality of indication switches, is activated; and an inverter circuit for inverting one of said two stable state outputs of said indication display time control circuit when a heart-pulse frequency indication switch, among said plurality of indication switches, is activated so that only the heart-pulse frequency data is read out.

2. Physical exercise appliance comprising:

a rotary load member;

a heart-pulse sensor for detecting the heart-pulse frequency of the user during the application of his physical energy to rotation of the rotary load member, said heart-pulse sensor generating a pulse frequency output signal related to the detected heart-pulse frequency;

a rotation sensor for detecting the number of rotations of the rotary load member and generating a rotation signal related to the number of rotations;

computing means for computing heart-pulse frequency data and exercise data, including exercise speed, in response to the pulse frequency output signal and rotation signal;

a single digital indicator device for selectively displaying said heart-pulse frequency data or said exercise data computed by said computing means;

a plurality of display lamps for indicating which data, either heart-pulse frequency data or exercise data, is being displayed on said digital indicator device;

a plurality of display switches for designating the data to be displayed on said digital indicator device;

means for automatically and alternately causing said exercise data and said heart-pulse frequency data to be displayed on said digital indicator device at predetermined intervals and for turning on the display lamp corresponding to the data currently displayed on said digital indicator device;

said heart-pulse sensor having a connecting plug which is removably mounted to a heart-pulse sensor mounting hole of an indicator case in which the digital indicator device is disposed;

a plug switch located on said indicator case, which plug switch is opened and closed dependent on the attachment and removal of said connecting plug to and from said heart-pulse sensor mounting hole, and means responsive to said plug switch for permitting only the exercise data to be indicated on said digital indicator device when the connecting plug is removed.

3. The physical exercise appliance as set forth in claim 3, wherein the exercise data includes an exercise period of time and an exercise speed.

* * * * *